United States Patent [19]

Zimmerman

[11] Patent Number: 4,583,618

[45] Date of Patent: Apr. 22, 1986

[54] COORDINATED STAGE SYSTEM WITH ARTICULATE MEANS

[76] Inventor: Rudi M. Zimmerman, 2879 Ridgeway Ave., Rochester, N.Y. 14626

[21] Appl. No.: 671,593

[22] Filed: Nov. 15, 1984

[51] Int. Cl.[4] ..... E04G 5/08

[52] U.S. Cl. ..... 182/223; 182/119

[58] Field of Search ..... 182/223, 222, 119, 130–136, 182/141–145, 104, 105

[56] References Cited

U.S. PATENT DOCUMENTS

| | | | |
|---|---|---|---|
| 405,195 | 6/1889 | Ayres | 182/119 |
| 1,356,819 | 10/1920 | Heydecke | 182/223 |
| 2,318,493 | 5/1943 | Johnson | 182/119 |
| 3,289,788 | 12/1966 | Evans | 182/223 |
| 4,499,967 | 2/1985 | Anderson | 182/145 |

FOREIGN PATENT DOCUMENTS

| | | | |
|---|---|---|---|
| 362729 | 4/1906 | France | 182/113 |
| 93137 | 2/1969 | France | 182/142 |
| 2424987 | 1/1980 | France | 182/150 |

*Primary Examiner*—Reinaldo P. Machado
*Assistant Examiner*—Alvin Chin-Shue
*Attorney, Agent, or Firm*—Samuel R. Genca

[57] ABSTRACT

A coordinated stage system with articulate means for interconnecting two or more stages in line and in series for use on scaffolding equipment, pole jacks, bridges, docks and the like is disclosed.

The coordinated stage system provides a continuous path wherein the length of the path may be increased and changes in elevation are accomplished by a novel joint arrangement.

2 Claims, 9 Drawing Figures

COORDINATED STAGE SYSTEM WITH ARTICULATE MEANS

BACKGROUND OF THE INVENTION

1. Field of the Invention

The present invention relates to scaffolding equipment and more particularly to a novel coordinated stage system for scaffolding equipment, pole jacks, bridges, docks and the like.

2. Prior Art

Although the present invention is suited for more general application, it is particularly adapted for use in scaffolding equipment wherein a pole jack or pump jack is raised or lowered on an upright pole to support a stage, platform or plank on which a workman or workmen can stand. The pole jack or pump jack and pole are well known to those skilled in the art and may be seen in U.S. Pat. Nos. 3,473,774 and 4,382,488. The pump jacks may be purchased from Hoitsma, Patterson, New Jersey. The pump jacks contain means which clamp on to the upright pole and include a foot pump which is utilized for raising or lowering the pump jack on the upright poles. The pump jack includes an extended arm on which can be placed the aforesaid stage, platform or plank on which a workman or workmen can stand. Generally, two pump jacks are utilized to support a single stage platform or plank; however, where the exterior of the building is of sufficient length and where three pole jacks or poles are required to be used for performing work on the building, then in that case the horizontal stages platform or planks are either placed on top of each other at the bearing ends thereof or placed in a side-by-side relationship on the pump jacks. The three pump jacks may be operated simultaneously by three separate workers or by a single worker raising or lowering each pump jack in sequence to thereby move the platform up and down the exterior of the building. The problem with this prior art arrangement of the pump jacks for stages, platforms or planks is that if the stages rest on the pump jacks in a side-by-side relationship extending the side-byside stages at the ends thereof, a serious hazard is presented since a workman concentrating on the building may fall off the end of one of the stages since the path is not in line in series and continuous. Alternatively, if the stages, platforms or planks are in a continuous path and series with one another by overlapping each other and present a step, this also presents a safety hazard since a workman may stumble over the step created by the overlapping stages, platforms or planks. Further, when three or more pump jacks or poles are utilized, it is difficult to coordinate the raising and lowering of the pump jacks or stages since the stages, platforms or planks in the prior art merely set on the pole jacks and are not connected to each other. Accordingly, there exists a pressing need for a coordinated stage system wherein two or more stages may be coupled together for use on scaffolding, pump jacks, pole jacks and the like which are safe to use, inexpensive to manufacture, may easily be uncoupled or dissambled on the pole jack or pump jack and other scaffolding equipment.

SUMMARY OF THE INVENTION

Briefly described, a coordinated stage system with articulate means in accordance with a preferred embodiment of the invention includes first and second longitudinal stages, each of the stages including a pair of diametrically opposed longitudinal side rails and a deck supported by the pair of diametrically opposed longitudinal side rails. In accordance with the invention, an articulate means pivotally joins the first and second stages in line and in series about a common axis perpendicular to the pair of diametrically opposed longitudinal rails of the first and second stages. The articulate means includes a first rung in the first stage coaxially disposed in the common axis of the articulate means. The first rung is fixed between the pair of diametrically opposed longitudinal side rails at one end of the first stage and extension bracket means fixed to the second stage and extending therefrom pivotally coaxially couples the second stage to the first rung of the first stage. The aforesaid coordinated stage system may be supported on three spaced-apart pole jacks and upright poles to provide a continuous path from the first pole jack to the third pole jack and each of the stages may be lifted or lowered by any one of the three pole jacks wherein the first and second stages are coordinated by the articulate means. If desired, one of the first and second stages or both of them may be coupled to the first and third pole jacks and for additional safety when raising or lowering the pole jacks on the poles.

BRIEF DESCRIPTION OF THE DRAWINGS

The invention will be better understood upon consideration of the following detailed description taken together with the accompanying drawings in which like elements in the various figures have like designations and in which.

DESCRIPTION OF THE PREFERRED EMBODIMENT

Figure 1:
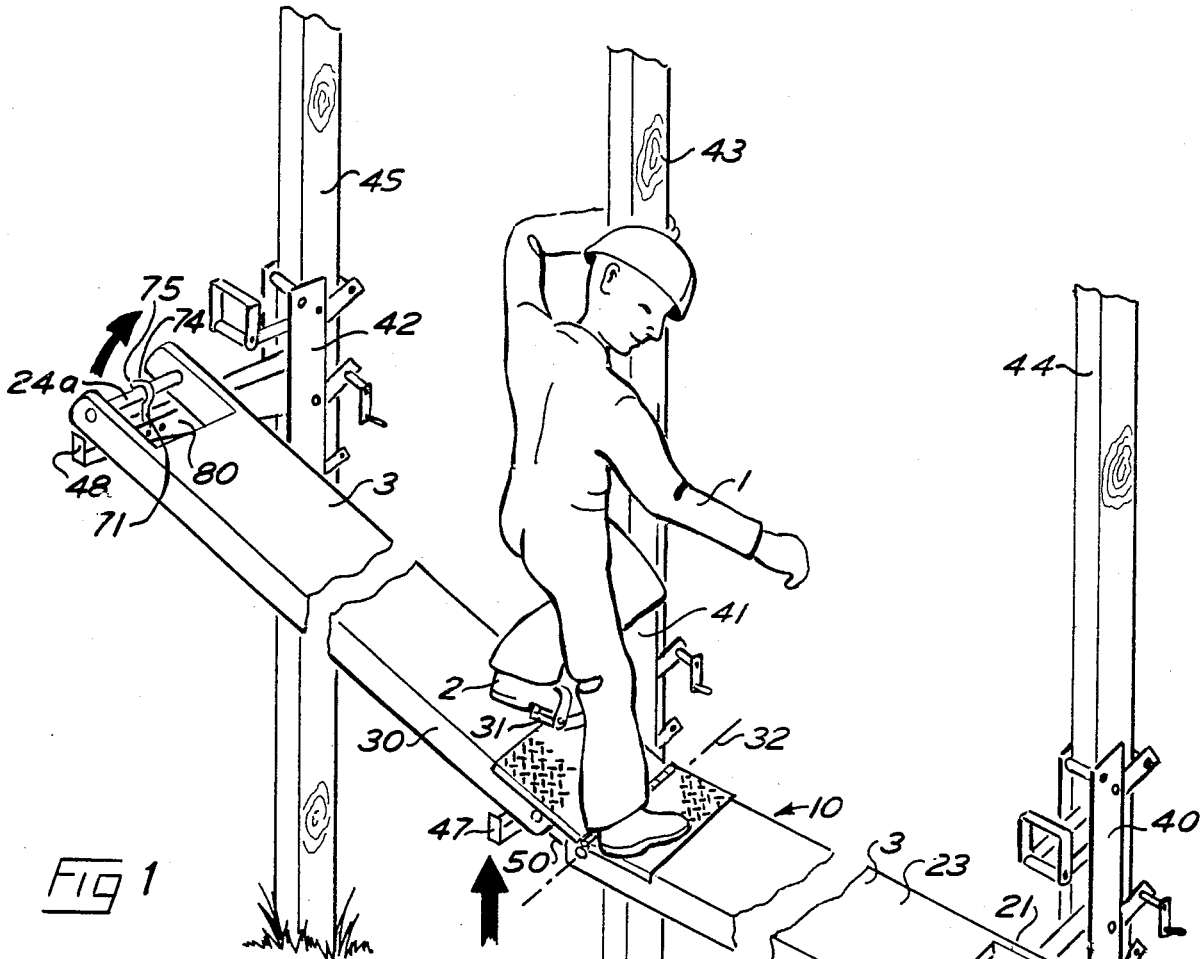
FIG. 1 is a perspective view of a coordinated state system in accordance with a preferred embodiment of the invention in which two stages of the system are shown at different elevations during raising of pole jacks.

The coordinated stage system 10 of the present invention will be described with particular reference to the preferred embodiment illustrated in the drawing. It should be understood that the drawing illustrations and description are to be taken only as illustrative of the preferred embodiment of the coordinated stage system 10 of the present invention and should be understood in a general way and not in a restrictive way.

FIG. 1 shows a coordinated stage system 10 in accordance with the invention for providing a continuous, in series and in line working surface or path 3 for a first stage 20 and a second stage 30 such as the type manufactured and sold by R. D. Werner Co. Inc. under the trademark "TASK-MASTER" of R. D. Werner Co. Inc. The coordinated stage system 10 is supported by three pole jacks or pump jacks, 40, 41, 42 such as the types which are manufactured by Hoitsma of Patterson, N.J. A man 1 is shown pumping pump jack 41 with his left foot 2 in the foot pump 31 which causes the pump jack 41 to ride up the pole 43. Pump jack 40 is coupled to pole 44 while pump jack 42 is coupled to pole 45. The pump jacks 40, 41, 42 each include arms 46, 47, 48 respectively for supporting the coordinated stage system 10.

Referring now to FIGS. 1, 3, 8 and 9, the coordinated stage system 10 includes the first stage 20 and the second stage 30. The first stage 20 includes diametrically opposed side rails 21, 22 and a platform 23 supported by the diametrically opposed rails 21, 22. Interposed between the side rails 21, 22 of the first stage 20 are a first rung 24 and a second rung 25. The first stage 20 and second stage 30 are both the same and are preferably made of aluminum material so as to be lightweight and easily maneuvered as is well known to those skilled in the art. The same structural elements in the first stage 20 and second stage 30 are given the same numerical designation with the addition of small letter "a" to the structural elements in the second stage 30. The second stage 30 includes diametrically opposed rails **21*a* and 22*a* and a deck 23*a* supported on the diametrically opposed rails 21*a* and 22*a*. In accordance with the invention, the coordinated stage system 10 includes articulate means 50 for pivotally joining the first stage 20 and the second stage 30 in line and in series about a common axis 32 perpendicular to the pair of diametrically opposed longitudinal rails 21, 22 of the first stage 20 and perpendicular to the diametrically opposed longitudinal rails 21*a*, 22*a* of the second stage 30. A rung 25*a* in the second stage 30 is partially cut away to show details of the articulate means 50**.

Figures 3, 4, 5, 6, 7:
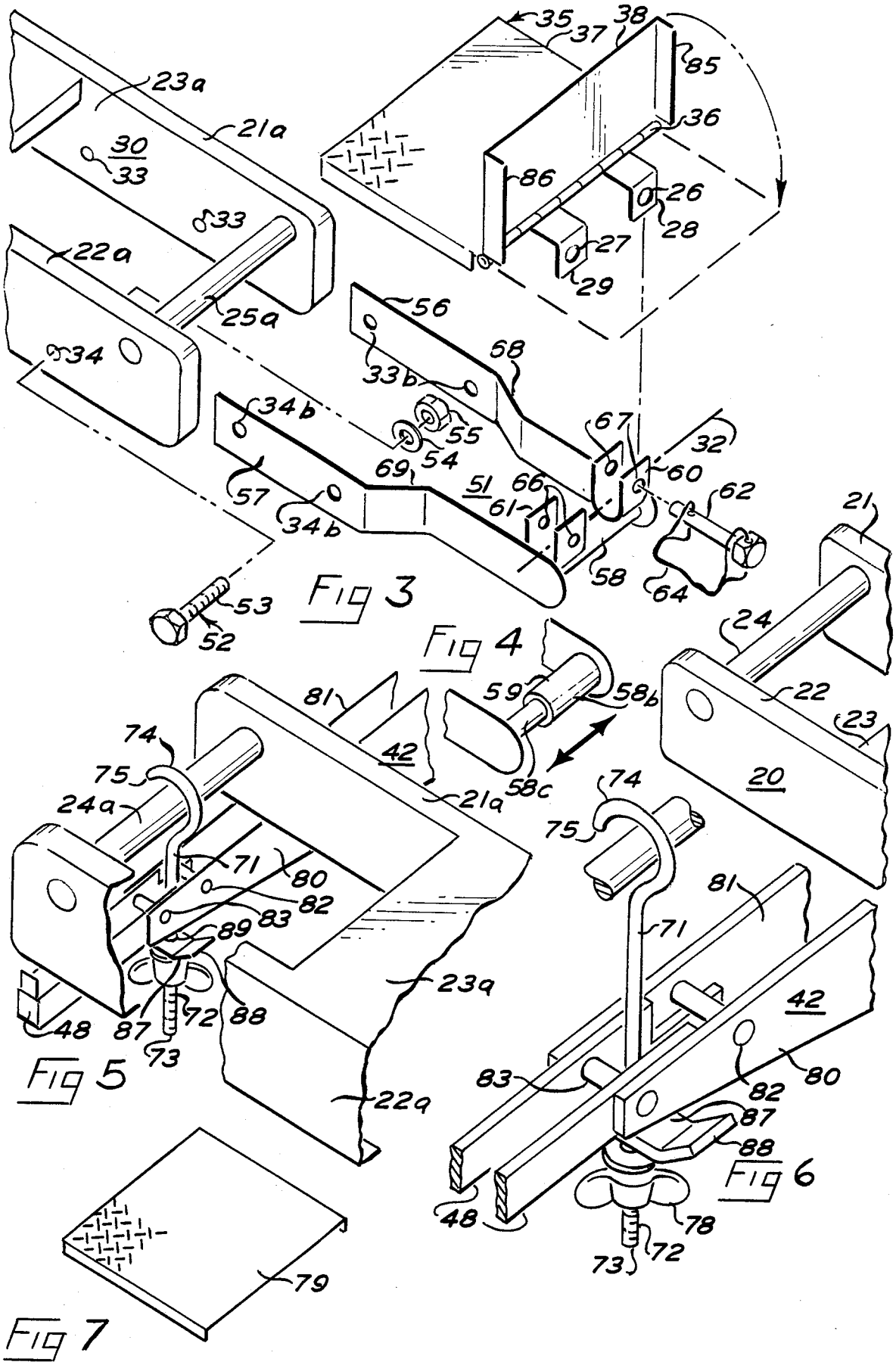
FIG. 3 is an exploded perspective view showing structural elements of the coordinated stage systems in accordance with a preferred embodiment of the invention illustrated in FIG. 1.
FIG. 4 is a fragmentary perspective view of a modification of the invention shown in FIG. 1 to accommodate various stages having different widths.
FIG. 5 is a fragmentary perspective view similar to FIG. 2 only showing a modification of the safety means of FIG. 2.
FIG. 6 is a fragmentary perspective view similar to FIG. 5 showing in greater detail the modification shown in FIG. 5.
FIG. 7 shows a floor covering plate utilized in the invention shown in FIG. 1.
Figures 8, 9:
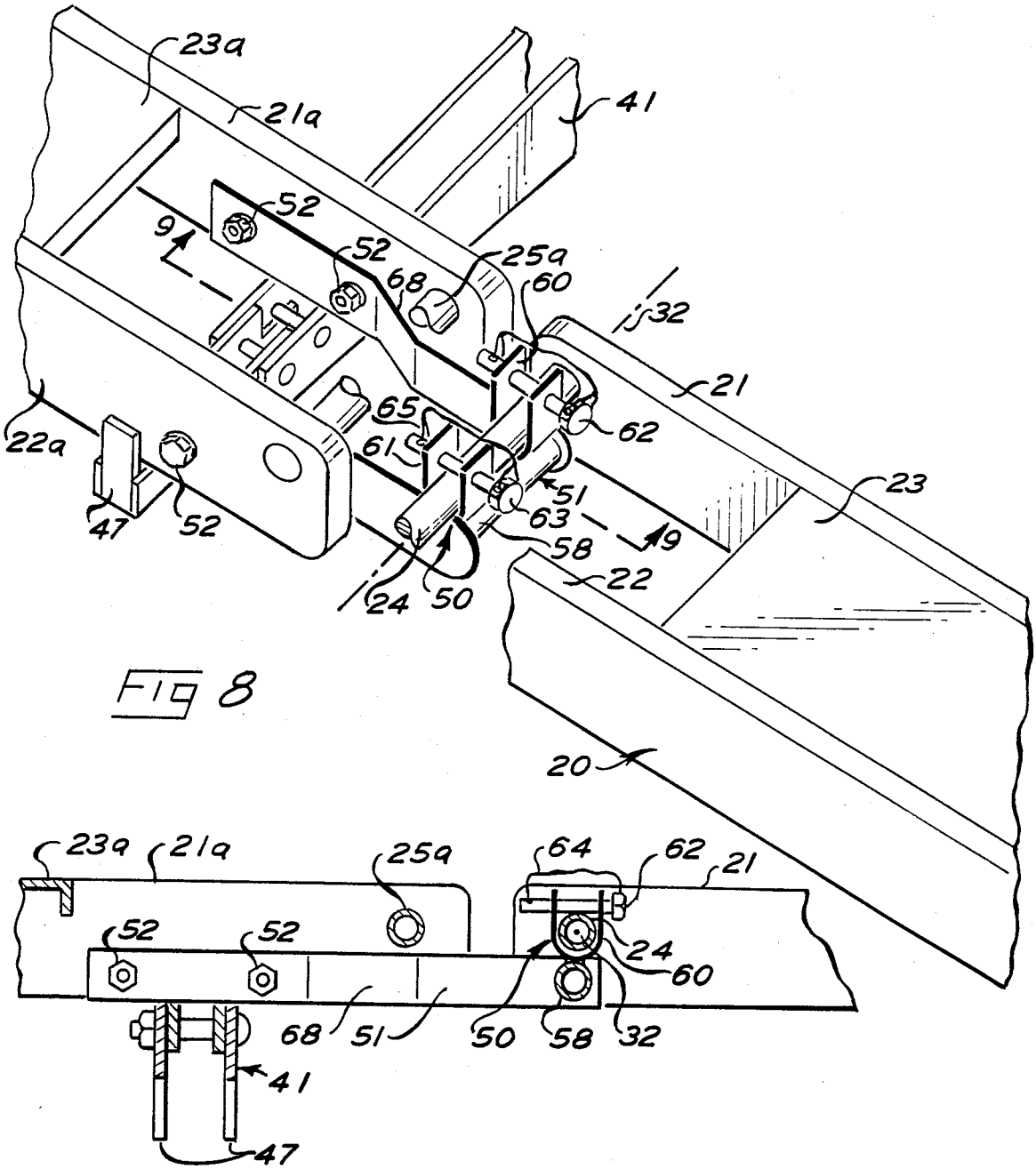
FIG. 8 is a fragmentary perspective view of the coordinated stage system in accordance with the preferred embodiment of the invention.
FIG. 9 is a cross-sectional view taken along line 9—9 of FIG. 8 showing further details of the coordinated stage system of FIG. 8.

Referring in particular to FIG. 3, the articulate means 50 includes extension bracket means 51 fixed to the diametrically opposed side rails **21*a* and 22*a* by fasteners 52 through holes 33 in side rail 21*a* and through holes 34 in side rails 22*a* in corresponding holes 33*b* and 34*b* in bracket means 51. The fasteners 52 may for example include a bolt 53, lock washer 54 and nut 55 or other fasteners such as rivets (not shown). The extension bracket means 51 includes diametrically opposed longitudinally extending brackets 56, 57 welded to an intermediate spacer bar 58 and cradle brackets 60, 61 adapted to receive the rung 24 of the first stage 20 in pivotal cooperative relationship along the common axis 32. The rung 24 is held captive to the cradle brackets 60, 61 by locking pins 62, 63**.

The pins 62, 63 include safety wires 64, 65 respectively for maintaining the pins 62, 63 in retaining holes 66, 67 in the cradle brackets 61, 62 respectively. The extension brackets 56, 57 include inwardly bent offset portions 68, 69 so that the extension bracket means 51 can fit between the diametrically opposed side rails 21, 22 of the first stage 20. The spacer bar 58 has a length which together with the thickness of the extension brackets 56, 57 welded thereon will fit between the diametrically opposed rails 21, 22 of the first stage 20. Accordingly, the spacer bar 58 may be adapted for various widths of the first and second stages 20, 30 respectively so that the stages 20, 30 may be in line and in series with each other. The spacer bar 58 may, if desired, be of a telescopic spacer bar 59 as shown in FIG. 4 to accommodate various sizes of the first stage 20 and the second stage 30. If the telescopic spacer bar 59 is desired, then the telescopic spacer bar 59 may be constructed of two telescoping pieces **58*b*, 58*c*** without departing from the invention.

The articulate means 50 between the first stage 20 and the second stage 30 may be covered by a straight deck plate 79 shown in FIG. 7 or by a more preferred hinged deck plate 35 as shown in FIG. 3. A hinged deck plate 35 includes a hinge 36 coupling a first deck portion 37 and a second deck portion 38. The hinged deck 35 may be secured to the articulate means 50 by deck brackets 28, 29 which include holes 26, 27 through which the locking pins 62, 63 may be inserted to retain the hinged deck 35 over the articulate means 50 and supported by the first stage 20 and second vertical stage 30 laterally by side deck portions 85, 86.

Figure 2:
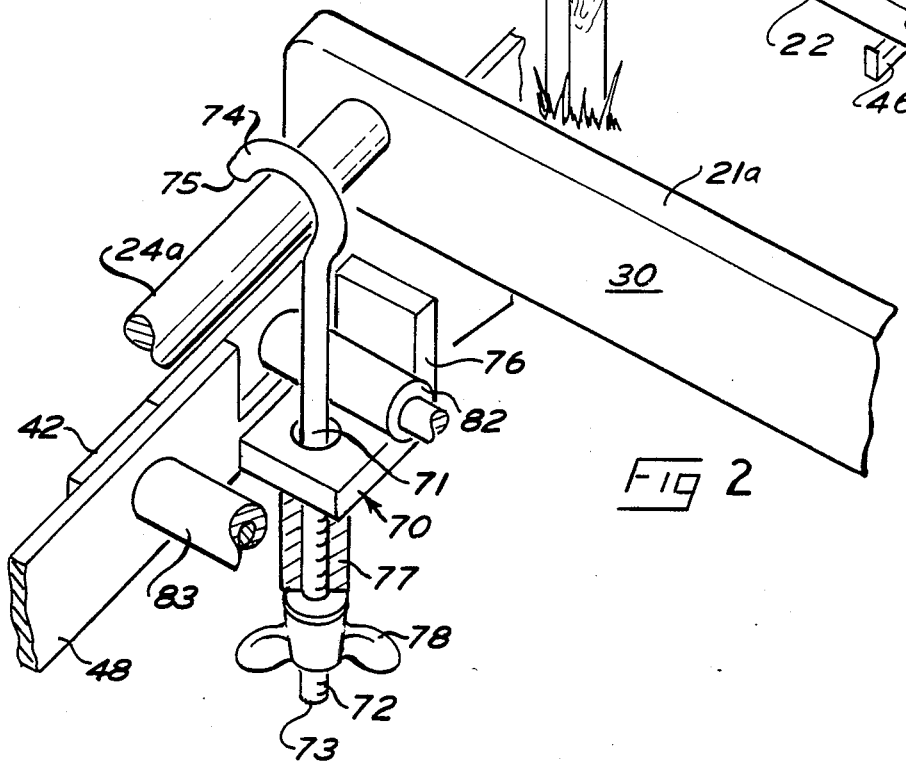
FIG. 2 is a fragmentary perspective view taken along line 2—2 of FIG. 1 showing details of a safety means for securing one end of one of the two stages to the pole jack in a safe condition.

If desired, the coordinated stage system 10 may be secured to one of the pump jacks namely 42 by a rung locking means 70 as shown in FIG. 2. The rung locking means 70 includes a longitudinal bolt 71 having a threaded section 72 at one end 73 and a hook portion 74 at the other end 75. The hook portion 74 is adapted to retain the rung **24*a* within the hook portion 74. The rung locking means 70 also includes an angle bracket 76 welded to a sleeve 77 through which the longitudinal bolt 71 extends therethrough. The angle bracket 71 is dimensioned to fit between spaced-apart arms 80, 81 of the pump jack 42. The pump jack 42 includes a pin 83 fixed to the arms 80, 81 and a hinge pin 83 of the pump jack 42 for pivotally supporting the composite arm 48 of the pump jack 42. The angle bracket 76 coacts with the pin 82 to lock the rung 24*a* and the second stage 30 to the jump jack 42 by tightening the wing nut 78 on thread 72 of the longitudinal bolt 71. Alternatively, the rung locking means 70 may be modified by eliminating the angle bracket 76 and the welded sleeve 77 and replace the angle bracket 76 and the welded sleeve by a tie brace 87 having upwardly extending brace arms 88 and a bolt hole 89 therebetween for receiving the bolt 71 as shown in FIGS. 5, 6**.

OPERATION

In the operation of the coordinated stage system 10, the second stage 30 with the articulate means 50 and extension bracket means 51 are placed on pump jacks 41 and 42 and are supported thereon. The second stage 30 may be secured to the pump jack 42 by the longitudinal bolt 71 by placing the hook portion 74 over the rung **24*a* and slipping the sleeve 77 and bracket 76 over the longitudinal bolt 71 and placing the bracket 76 under the pin 82 of the pump jack 42. The hook portion 74 couples the rung 24*a* of the second stage 30 to the pump jack 42 by treading the wing nut 78 on the longitudinal bolt 71 until the second stage 30 is secured to the pump jack 42. The rung 24 of the first stage 20 is then placed on the cradle brackets 60, 61 of the extension bracket means 51 in line with the common axis 32. The deck portion 37 of the hinged deck 35 is placed on the deck 23*a* of the stage 30 over the extension bracket means 51. The deck brackets 28, 29 of the hinged deck 35 are aligned with the cradle brackets 60, 61 to permit the pins 62, 63 to be inserted through the holes 26, 27 of the deck brackets 28, 29 and the holes 66, 67 of the cradle brackets 60, Once inserted, the pins 62, 63 are secured to the cradle brackets 60 by the safety wires 64, 65. The first and second stages 20, 30 respectively, are now coordinated and articulated for relative movement therebetween and may be pivoted about common axis 32. The first stage 20 is also placed upon the third pump jack 40 for support proximal to rung 25 of the first stage 20. The first stage 20 is also supported at rung 24 by the articulate means 50 by the coaction between the rung 24 and the cradle brackets 60, 61. The first and second stages 20 and 30 respectively are thus supported by the pump jacks 40, 41, 42 and are coordinated and aritculated for changes in elevation between the pump jacks 40, 41, 42**.

The coordinated stage system 10 may be utilized with or without the hinged deck 35; however, since the deck 23 of the first stage 20 and deck **23*a* of the second stage 30 do not extend and cover the articulate means 50, it may be desirable to utilize the flat cover plate 79 to provide a continuity with decks 23, 79 and 23*a***.

It may also be desired to eliminate the angle bracket 76 and sleeve 77 of the rung locking means 70 for locking the rung **24*a* and second stage 30 to the pump jack 42 and substituting therefore the tie brace 87 over the longitudinal bolt 71. The tie brace 87 couples the rung 24*a* to the arms 80, 81 of the pump jack 42 and couples the second stage 30 to the pump jack 42**.

The locking means 70 is particularly useful in the conditions illustrated in FIG. 1 or variations thereof wherein the pump jack 42 is in a substantially higher elevation than the pump jacks 41 and 42. The second stage 30 is locked to the pump jack 42 thereby being prevented from slipping off the pump jacks 41, 42. Since the first and second stages 20, 30 respectively are coupled by articulate means 50, the first stage 20 will not slip off the pump jack 40.

When the first and second stages 20, 30 respectively are at the same horizontal level, the rung locking means 70 may be omitted; however, due care should be taken for insuring that the loading on the first stage 20 is of a magnitude which will not cause the second stage 30 to pivot about the support arm 47 of the pump jack 41. That is, as long as the sum of all of the forces acting on the second stage 30 times their respective distances from the support arm 47 of the pump jack 41 is greater than the sum of all of the forces acting on the cradle brackets 60, 61 along the common axis 31 times their respective distances from the support arm 47 of the pump jack 41, the second stage 30 will not pivot about the support arm 47 of the pump jack 41.

While the foregoing improvement of the invention has been shown and used with pump jacks 40, 41, 42, it should be understood that the invention may be used with pole jacks, ladder jacks, work horses, platforms and other scaffolding equipment (all of which are not shown) without departing from the invention

Having thus described the invention, it will be evident that other modifications and improvements may be made by one skilled in the art which would come within the scope of the annexed claims.

What is claimed as new and desired to be secured by Letters Patent of the United States is:

1. A coordinated stage system for supporting a person thereon comprising:

(a) first and second longitudinal stages, each of said first and second stages having:

(i) a pair of diametrically opposed longitudinal side rails, and (ii) a deck supported by said pair of diametrically opposed longitudinal side rails, (b) articulate means for pivotally joining said first and second stages in line and in series about a common axis perpendicular to said pair of diametrically opposed longitudinal rails of said first and second stages, (c) said articulate means includes (i) a first rung in said first stage coaxially disposed in said common axis of said articulate means, (ii) said first rung being fixed between said pair of diametrically opposed longitudinal side rails at one end of said first stage, (iii) extension bracket means fixed to said second stage and extending therefrom in cooperative relationship with said first rung of said first stage for pivotally coaxially coupling said second stage to said first stage;

(iv) said extension bracket means includes a pair of cradle support members positioned in cradling cooperative relationship to said first rung of said first stage for said pivotal movement of said first and second stages about said common axis, and (v) said pair of cradle support members include a locking means disposed above said common axis and above said first rung of said first stage when said first rung of said first stage is cradled within said pair of said cradle support members for pivotally locking said first rung of said first stage to said pair of said cradle support members so that said locking means and said rung of said first stage are visible to said person on said coordinated stage system.

2. The invention defined in claim 1 wherein said locking means includes a pair of locking pins extending through a corresponding pair of openings in said pair of cradle support members disposed above said common axis of said articulate means and positioned in cooperative relationship with said first rung of said first stage for pivotally locking said first stage to said second stage.

* * * * *